US011118382B2

(12) United States Patent
File

(10) Patent No.: US 11,118,382 B2
(45) Date of Patent: Sep. 14, 2021

(54) DOOR PROP DEVICE

(71) Applicant: Tolco Corporation, Toledo, OH (US)

(72) Inventor: Chris File, Maumee, OH (US)

(73) Assignee: Tolco Corporation, Toledo, OH (US)

( * ) Notice: Subject to any disclaimer, the term of this patent is extended or adjusted under 35 U.S.C. 154(b) by 746 days.

(21) Appl. No.: 15/975,134

(22) Filed: May 9, 2018

(65) Prior Publication Data

US 2018/0328088 A1 Nov. 15, 2018

Related U.S. Application Data

(60) Provisional application No. 62/504,084, filed on May 10, 2017.

(51) Int. Cl.
*E05C 17/00* (2006.01)
*E05C 17/54* (2006.01)

(52) U.S. Cl.
CPC ..... *E05C 17/025* (2013.01); *E05C 17/54* (2013.01)

(58) Field of Classification Search
CPC ..... E05C 17/025; E05C 17/54; E05C 19/18; E05C 19/182; E05C 19/188; E05F 5/04; E05F 2005/046; E05F 5/06; E05F 5/02; E05D 11/00; Y10S 292/17; Y10S 292/15; Y10T 16/61; Y10T 16/629; Y10T 16/5513; Y10T 16/628; Y10T 16/551; Y10T 16/6285; E05Y 2201/224
USPC ..... 292/343, 288, 342; 16/82, 86 R, 374, 16/86 B, 375
See application file for complete search history.

(56) References Cited

U.S. PATENT DOCUMENTS 5,335,396 A * 8/1994 Dolan ..... E05C 17/30 16/82
5,511,837 A * 4/1996 Dempsey ..... E05C 17/025 16/319
5,642,910 A * 7/1997 Betherum ..... E05C 17/025 16/319
D578,872 S * 10/2008 Healy ..... D8/402
7,506,905 B1 * 3/2009 George ..... E05C 17/025 16/82
7,904,992 B2 * 3/2011 Agster ..... E05D 11/1014 16/82
7,976,080 B1 * 7/2011 Duff ..... E05C 17/54 292/343
8,863,561 B2 * 10/2014 Orlov ..... E05C 17/54 70/14

(Continued)

FOREIGN PATENT DOCUMENTS

DE 379273 C * 8/1923 ..... E05C 17/54
FR 2771128 A1 * 5/1999 ..... E05C 17/54
WO WO-2014117785 A1 * 8/2014 ..... E05C 17/00

*Primary Examiner* — Christine M Mills
(74) *Attorney, Agent, or Firm* — Schaffer, Schaub & Marriott, Ltd.

(57) ABSTRACT

A door prop device that can be utilized to maintain a door in an open position is described. The door prop has a triangular shaped body with angled sidewalls that extend from a base. A projection extends from the angled sidewalls in a direction away from the base. A passageway extends through the projection. A member is rotatably positioned in the passageway with a first portion of the member extending from the passageway. The first portion has first and second concave surfaces. The first and second concave surfaces are disposed for engaging a hinge pin on a hinge for a door.

10 Claims, 8 Drawing Sheets

(56) References Cited

U.S. PATENT DOCUMENTS

Figure 1:
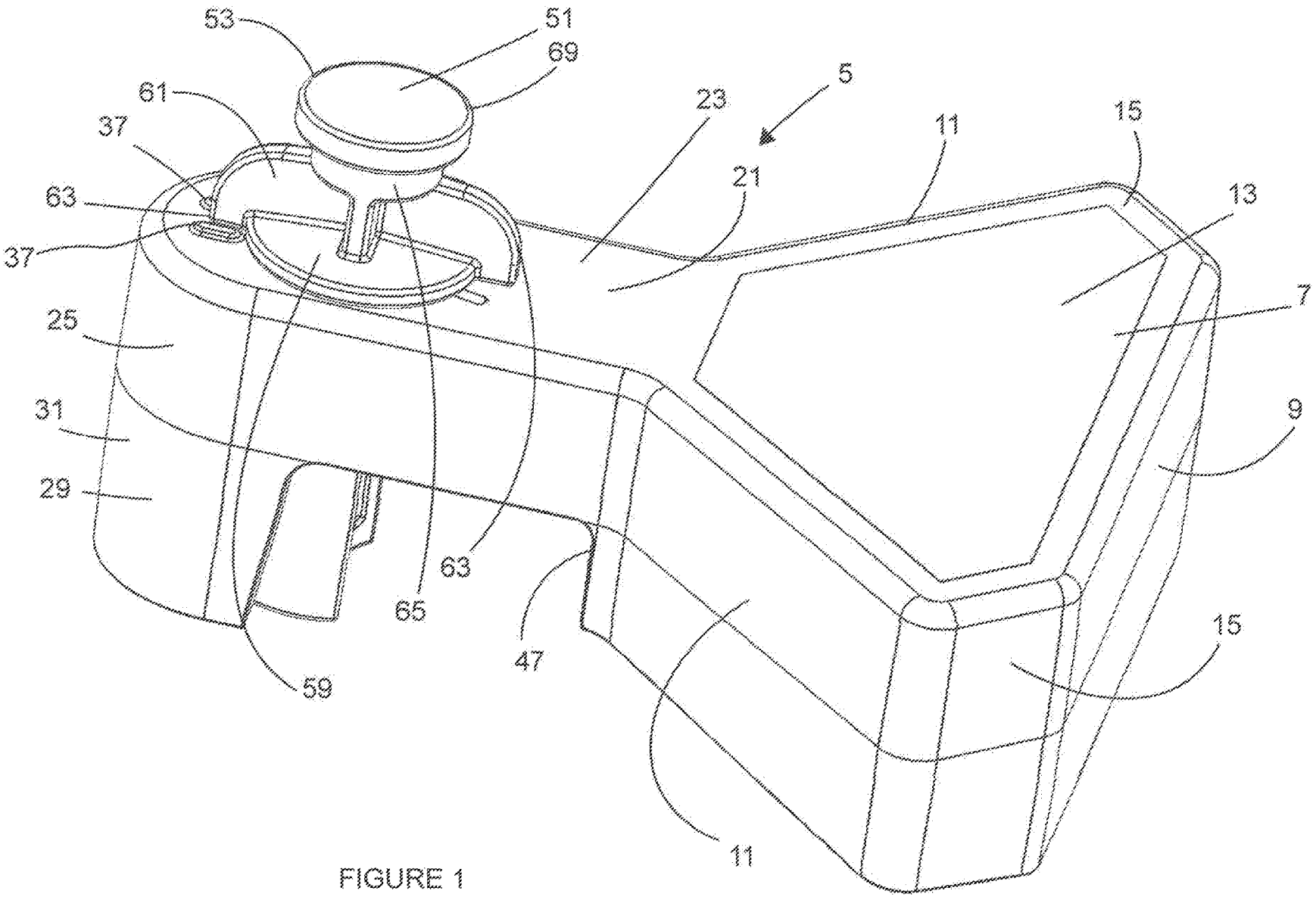

| | | | | |
|---|---|---|---|---|
| D719,015 | S * | 12/2014 | Hengler | D8/402 |
| 8,914,945 | B2 * | 12/2014 | Callahan | E05F 5/02 16/82 |
| 9,127,489 | B2 * | 9/2015 | Orlov | E05C 17/025 |
| 10,801,238 | B1 * | 10/2020 | Cox | E05C 17/025 |
| 2008/0047096 | A1 * | 2/2008 | Pistone | E05C 17/52 16/82 |
| 2009/0260182 | A1 * | 10/2009 | Hall | E05C 17/025 16/82 |
| 2010/0038921 | A1 * | 2/2010 | Kirkham | E05D 11/00 292/343 |
| 2010/0242226 | A1 * | 9/2010 | Hopkins | E05C 17/54 16/82 |

* cited by examiner

DOOR PROP DEVICE

CROSS REFERENCE TO RELATED APPLICATION

The present patent application is based upon and claims the benefit of provisional patent application No. 62/504,084, filed on May 10, 2017.

BACKGROUND OF THE INVENTION

The invention relates to a door prop which can be used to hold open doors in a building. The device is designed to be easily inserted and removed from the door and to be held on a clip, such a belt clip, when not in use in a door.

There are many applications, such as hotels, motels and commercial buildings where it is desirable to maintain a door in an open position. Frequently cleaning or moving operations can function much more quickly if the door to a room can be maintained in an open position. Current devices that are utilized to maintain a door in an open position frequently do not maintain the door in the desired position, are difficult to install and remove or do not accommodate different sizes of doors. Accordingly, there is a need in the industry for the door prop that always maintains the door in the open position, is easy to install and remove, can accommodate different size doors and be positioned in a convenient and easy to access location on the user of the door prop.

SUMMARY OF THE INVENTION

A door prop device that can be utilized to maintain a door in an open position is described. The door prop device is easy to install and remove from the door and will retain the door in the desired open position. The door prop is designed to be usable with the hinge mechanism found on most commercial doors. Other objects and advantages of the present invention will become apparent to those skilled in the art upon a review of the following detailed description of the preferred embodiments and the accompanying drawings.

IN THE DRAWINGS

Figure 2:
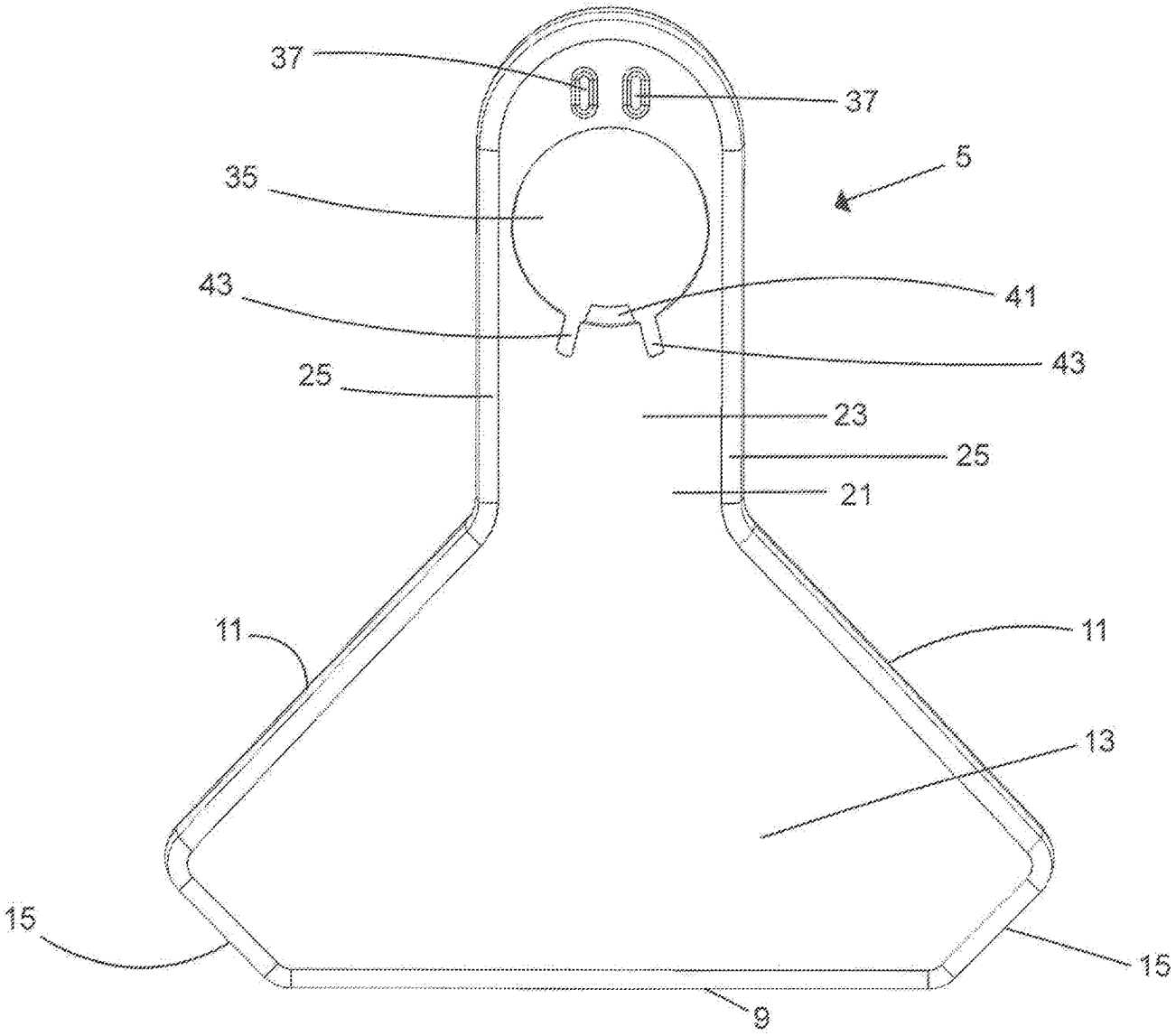
Figure 3:
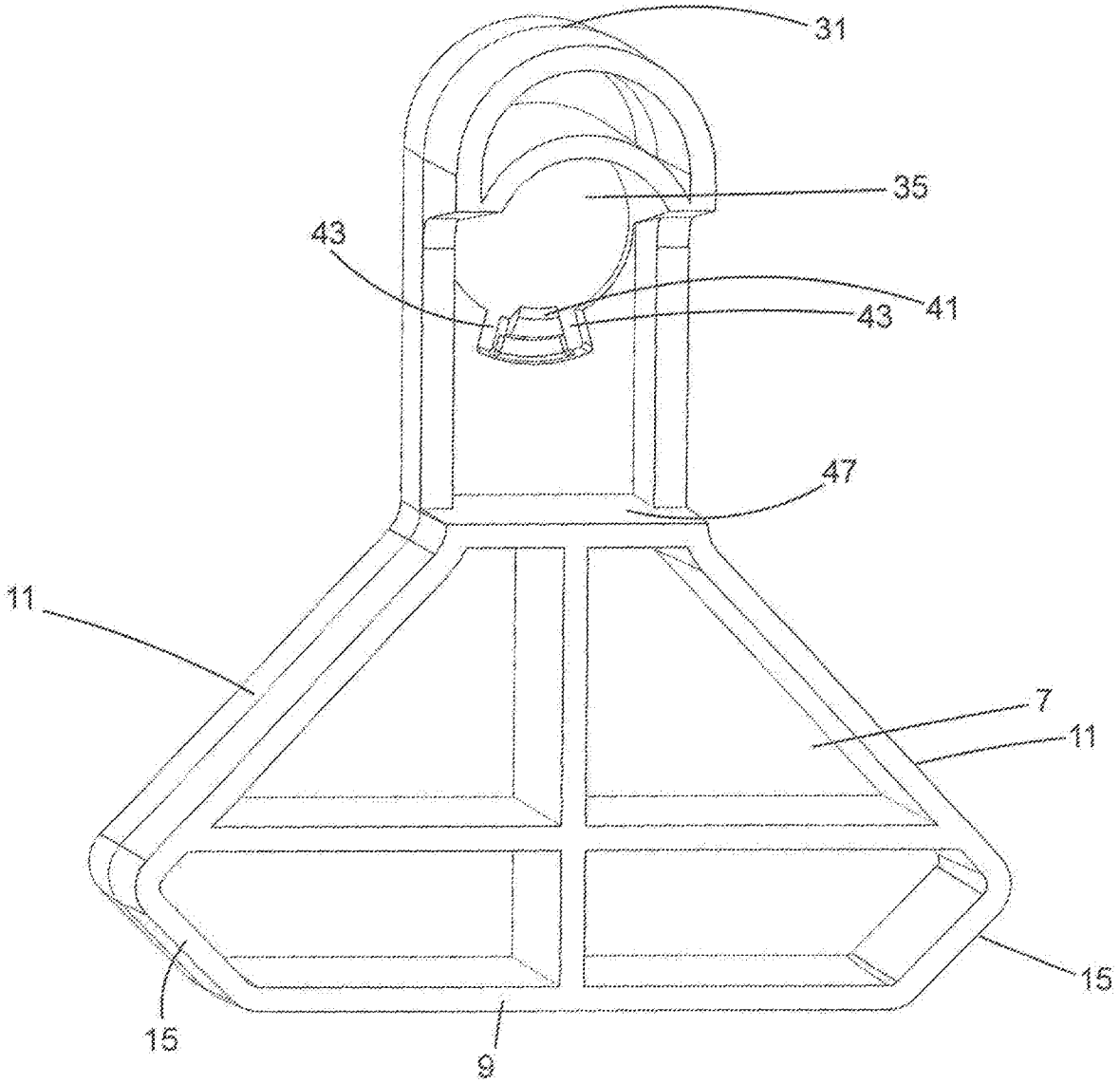
Figure 4:
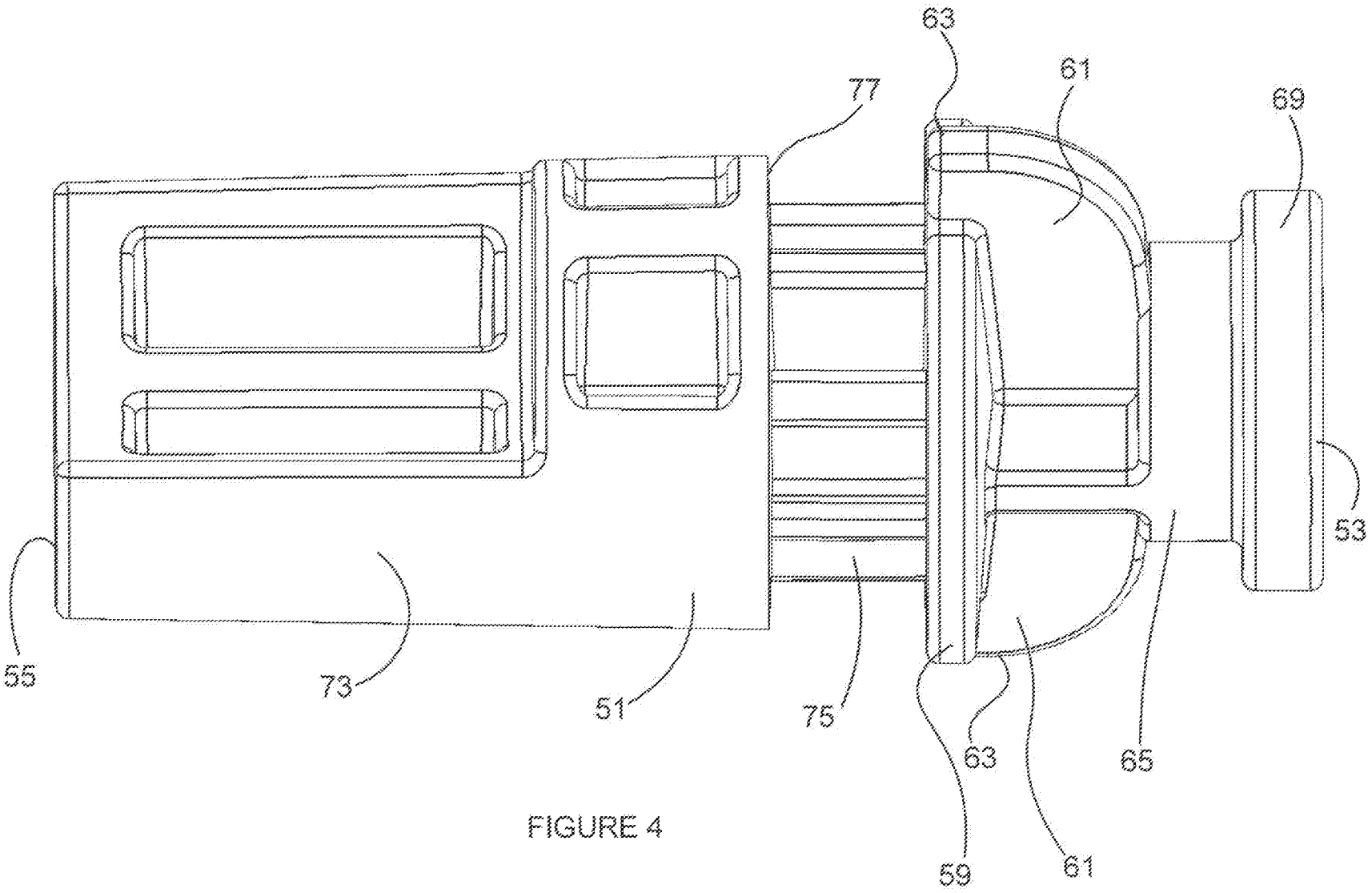
Figure 5:
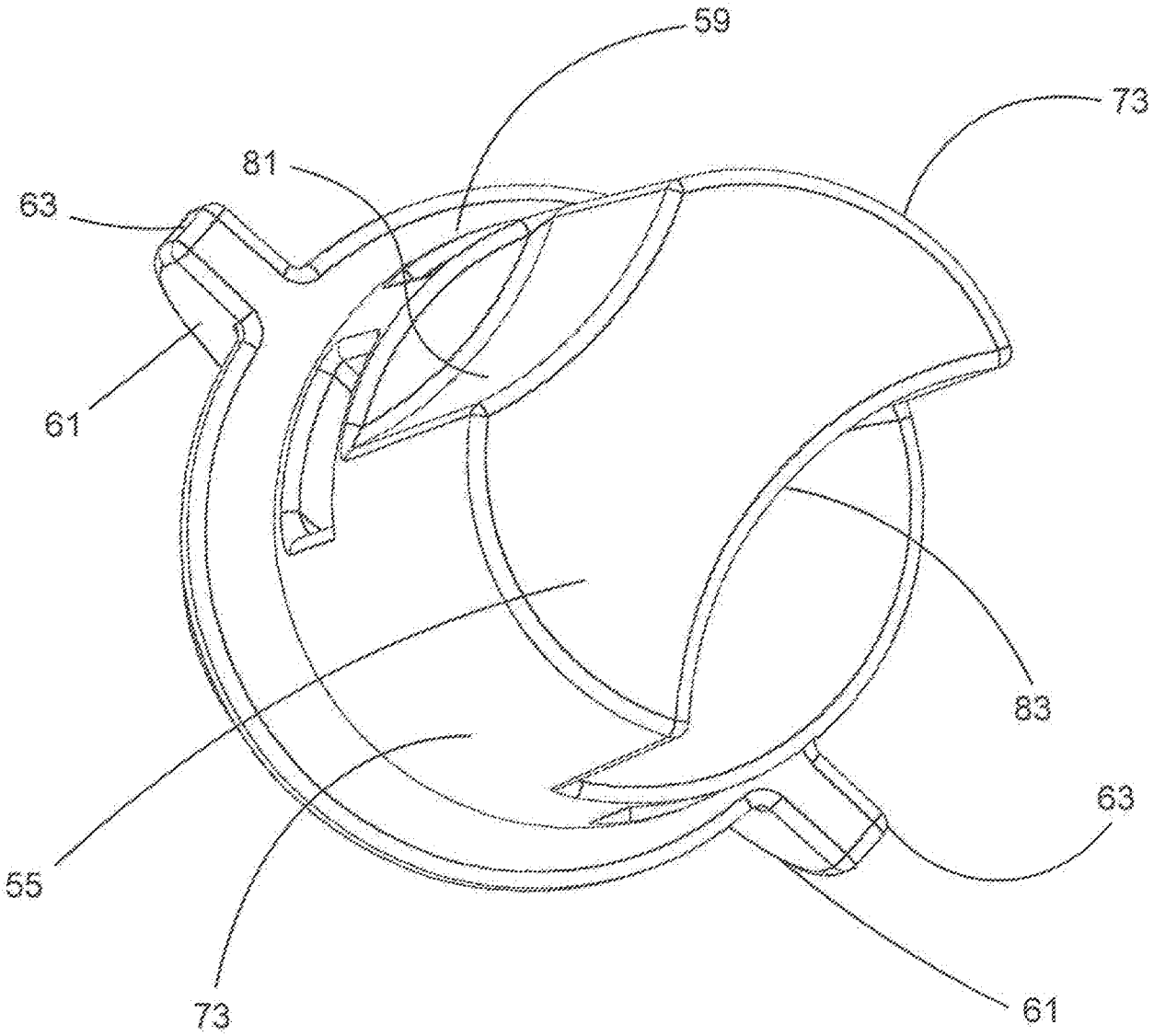
Figure 6:
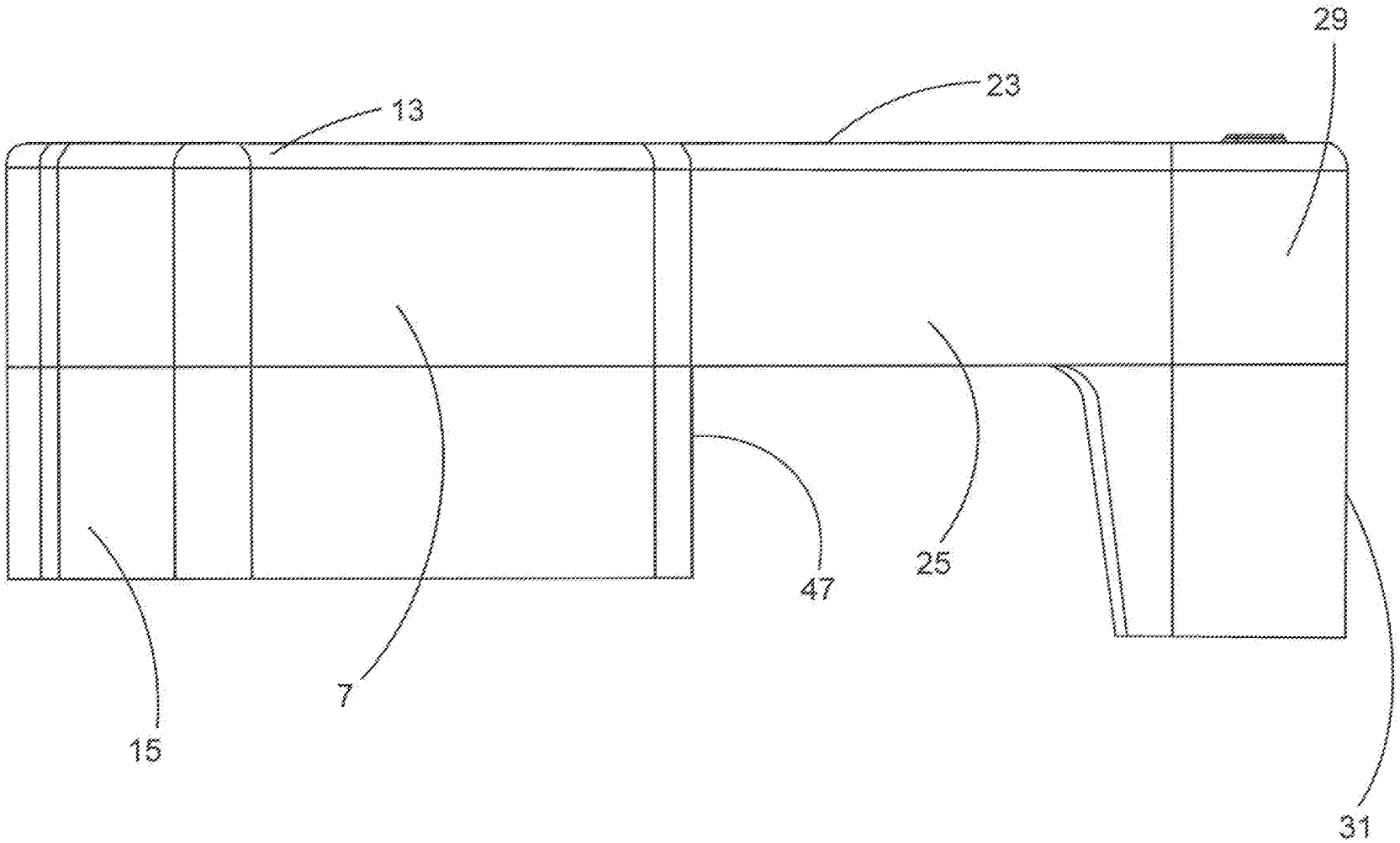
Figure 7:
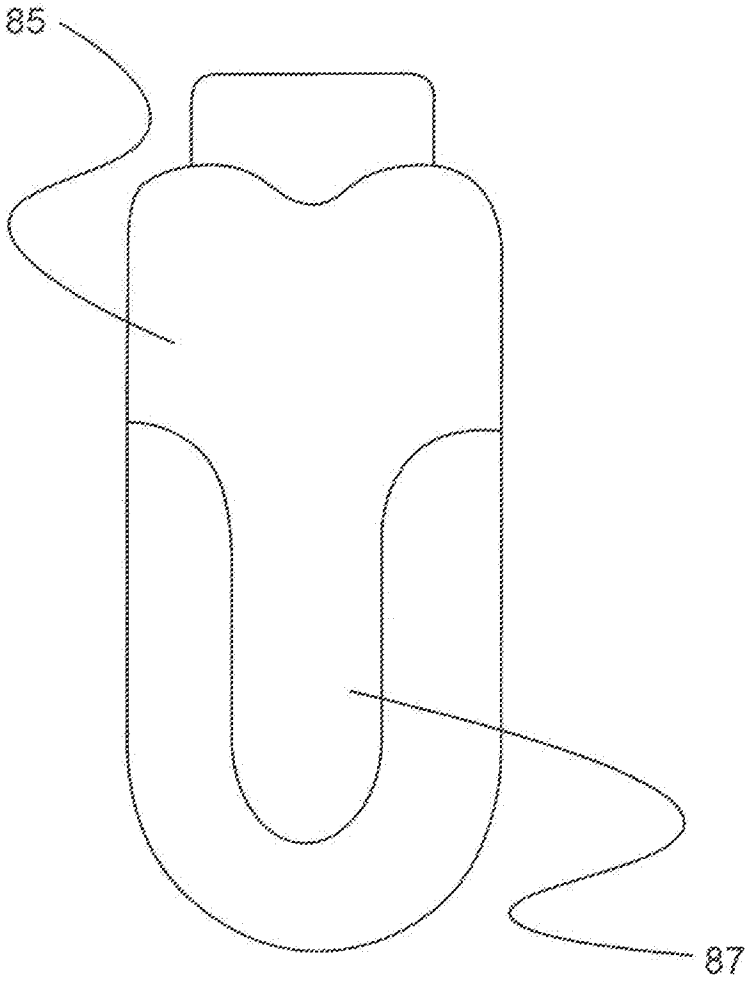
Figure 8:
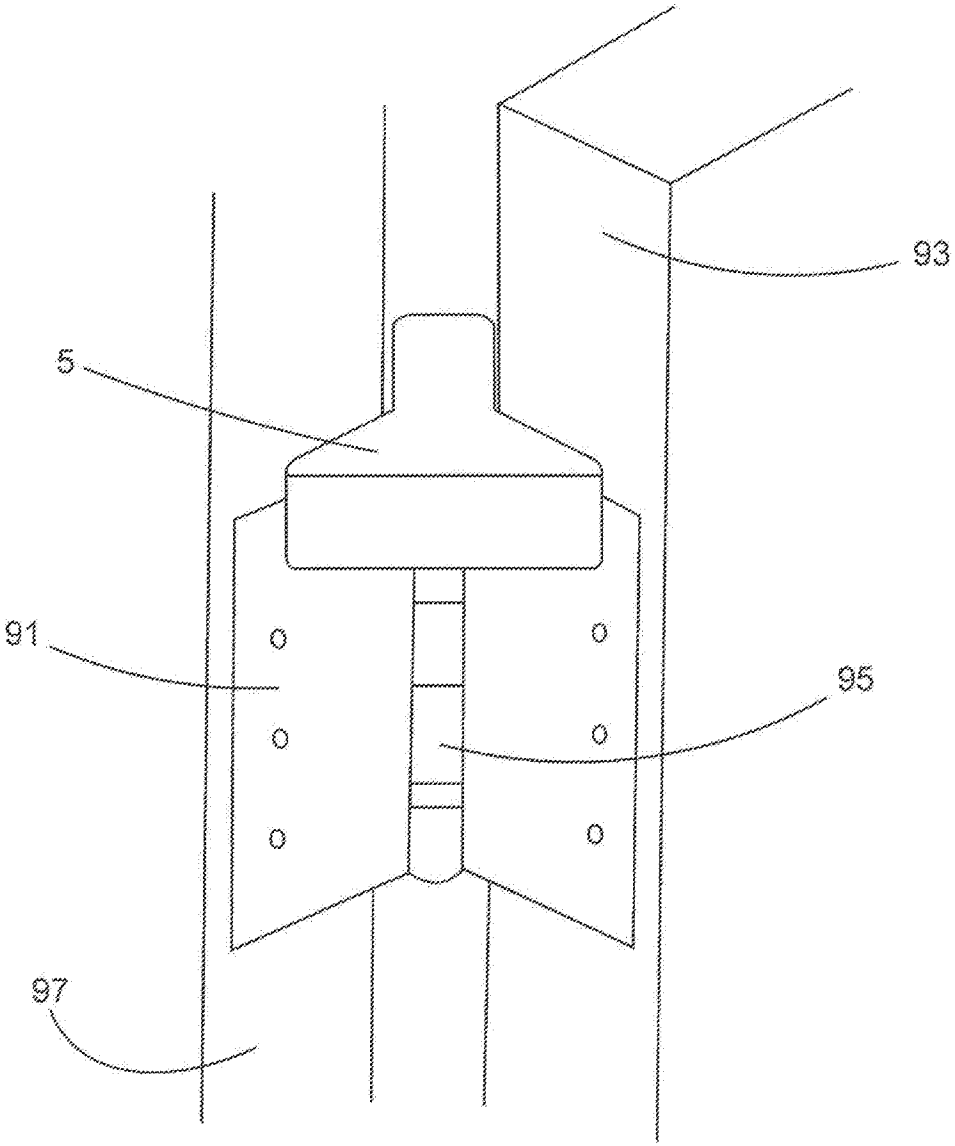

FIG. 1 is a perspective view of the invention.
FIG. 2 is a partial top view.
FIG. 3 is a partial bottom view.
FIG. 4 is a partial perspective view.
FIG. 5 is a partial perspective view.
FIG. 6 is a partial side elevational view.
FIG. 7 is a front elevational view of a feature of the invention.
FIG. 8 is a perspective view of the invention in use.

DETAILED DESCRIPTION OF THE INVENTION

The invention is directed to a door prop device that can be utilized to maintain a door in an open position. More particularly, the device is designed to be positioned over the hinge for the door and to engage the door and the jam for the door to maintain the door in an open position. The door prop device is designed to accommodate different sized hinges that are utilized in most buildings. The features of the invention will be more readily understood by referring to the attached drawings in connection with the following description.

The door prop device 5 has a body 7 having a triangular shape. The body has a base 9 and angled sidewalls 11 that extend from the base. A generally planar upper surface 13 extends from the base and the angled sidewalls. A chamfered wall section 15 can be used to connect the base 9 to the angled sidewalls.

A projection 21 having an upper surface 23 and substantially parallel sidewalls 25 extend from the angled sidewalls of the body 7 in a direction away from the base 9. The projection extends from the ends of the angled sidewalls that is spaced apart from the base. The upper surface 23 is substantially in the same plane as the planar upper surface 13 of the body 7. The sidewalls 25 have a height that is substantially one half of the height of the angled sidewalls 11 of the body 7. The end of the projection 21 that is spaced apart from the body 7 has an extension 29 with a curved wall 31 that extends from the sidewalls 25 in a direction away from upper surface 23 of the projection 21. The sidewall 25 and curved sidewall 31 have a combined height that is from about 5% to about 75% with a preferred range from about 10% to about 35% larger than the height of the angled sidewalls 11. A passageway 35 extends from the upper surface 23 through the projection 21. The passageway 35 is substantially cylindrical in shape and extends in a direction that is substantially perpendicular to the upper surface 23 of the projection 21. A pair of detents 37 are positioned on the upper surface 23 adjacent to the passageway 35. The detents are positioned on the end of the upper surface 23 that is spaced apart from the body 7. A resilient tab 41 extends from the upper surface 23 of the projection 21 into the passageway 35. At least one slot 43 is positioned in the upper surface 23 adjacent to the resilient tab 41. In practice it has been found preferable to have a slot positioned on each side of the resilient tab 41. The slots function to increase the resilient nature of the resilient tab 41.

An end wall 47 is positioned on the body 7 in parallel spaced apart relationship from the base 9. The end wall 47 extends between the ends of the angled sidewalls 11 that are below the projection 21 that are spaced apart from the base 9. The end wall is designed to engage a portion of a hinge 91 that is used to pivotally support a door 93.

A substantially cylindrical member 51 is rotatably positioned in the passageway 35 in the projection 21. The cylindrical member has a first end 53 that extends above the upper surface 23 of the projection 21 and a second end 55 that extends from the passageway 35 in a direction away from the upper surface 23. The cylindrical member 51 has a flange 59 positioned on first end 53 and the flange is designed to extend over the outer periphery of the passageway 35 and engage the upper surface 23 of the projection 21. The flange 59 is disposed to be substantially parallel to the upper surface 23. A ridge 61 is positioned on the first end 53 and extends in a direction that is substantially perpendicular to the flange 59. The ends 63 of the ridge 61 extend beyond the outer periphery of the flange 59. Either end 63 of the ridge 61 can be disposed to extend between the detents 37 on the upper surface 23 when the cylindrical member 51 is in a desired position. A cylindrical section 65 of the cylindrical member 51 is positioned above the ridge 61. A knob 69 having a cylindrical shape is positioned on the cylindrical section 65 that is spaced apart from the ridge 61. The knob has a diameter that is from about 25 percent to about 40 percent larger than the diameter of the cylindrical section 65. The second end 55 of the cylindrical member 51 has a generally cylindrical first portion 73 and a generally cylindrical second portion 75. The cylindrical second portion 75 extends from the cylindrical first portion 73 to flange 59. The first portion has a diameter that is from about 20 to about 30 percent larger than the diameter of the second portion. A shoulder 77 is formed in the cylindrical member 51 where the second portion is in contact with the first portion 73. A first concave recess 81 and a second concave recess 83 are formed in the second end 55 of the cylindrical member 51. The center of the first concave recess 81 is in alignment with one end 63 of the ridge 61 and the center of the second concave recess 83 is in alignment with opposite end 63 of the ridge 61. The first and second concave recesses have a radius of curvature that is from about 0.20 to about 0.75 inches with a preferred range from about 0.30 to about 0.45 inches. The center point for the radius of curvature for the first and second recess originate at different distances from the center line of the cylindrical number 51. The positioning of the center point from the radius of curvature creates a smaller first concave recess 81 and a larger concave recess 83 that are designed to accommodate different sizes of hinges. The center point for the radius of curvature for the first concave recess is spaced from about 0.25 to about 0.85 inches with a preferred range from about 0.55 to about 0.60 inches from the center line of the cylindrical number 51. The center point for the radius of curvature for the second concave recess is spaced from about 0.20 to about 0.80 inches with a preferred range from about 0.38 to about 0.46 inches from the center line of the cylindrical number 51. It should also be appreciated that radius of curvature for the first and second concave recesses can vary in dimension as long as the concave recesses can accommodate the desired hinge sizes. The shoulder 77 is positioned on the cylindrical member 51 in a location where the resilient tab 41 will engage the shoulder when the cylindrical member 51 is positioned in the passageway 35 with the flange 59 positioned on the upper surface 23 of the projection 21. The first and second concave recesses are designed and sized to engage a hinge pin 95 on a hinge 91 that is used to pivotally secure a door in an opening.

The flange 59 on the cylindrical member 51 engages the upper surface 23 on the projection 21 to keep the cylindrical member from advancing further into the passageway 35. The resilient tab 41 engages the shoulder 77 when the cylindrical member 51 is positioned in the passageway 35 with the flange 59 in engagement with the upper surface 23. The resilient tab 41 maintains the cylindrical member 51 in the desired position in the passageway 35. If, however, it is necessary to remove the cylindrical member 51 from the passageway 35 it is possible to displace the resilient tab to allow the cylindrical member to be removed from the passageway.

The end wall 47 located between the angled sidewalls 11 on the body 7 is disposed to engage the hinge pin area of the hinge to assist in positioning the door prop 5 in the desired location with respect to the door.

The cylindrical section 65 and knob 69 are designed to function as a securing device that can be positioned in a belt clip or similar device. Being able to carry the door prop on a belt clip or similar holding device allows the door prop to be located in a convenient location so that it is available when it is desired to use the door prop. The belt clip arrangement allows the cylindrical section 65 to slide into the receiving slot 87 on the belt clip 85 and the knob 69 to engage with the interior surface of the receiving slot to hold the door prop in position on the belt clip 85. This arrangement allows the door prop to be easily slip on and off of the belt clip for easy use of the door prop.

In operation, the door prop 5 is used to maintain a door 93 in an open position. When the door is open the door prop is positioned on top of one of the hinges 91 that pivotally connect the door to a wall. The extension 29 on the projection 21 extends over the hinge pin 95 of the hinge. The angled side walls 11 of the body 7 are configured to engage the edge of the door 93 and the surface of the door frame 97 respectively to retain the door in an open position. The angular relationship between the angled sidewalls 11 result in the door being held in a mostly open position. The cylindrical member 51 will be positioned in the passageway 35 so that either the first concave recess or the second concave recess engage the hinge pin 95 region of the hinge. The first or second concave recess will be selected based on the size of the hinge pin region of the hinge and the radius of curvature of the concave recesses. The first and second concave recesses are sized to accommodate almost all sizes of hinge pins used for doors in commercial applications. If it is necessary to change the concave recess to accommodate the hinge pin region of the hinge the cylindrical member 51 can be rotated so that either the larger or smaller concave recess is in position adjacent the hinge pin 95 of the hinge 91. To rotate the cylindrical member the knob 69 or the ridge 61 can be engaged to rotate the cylindrical member 51. It will be necessary to advance the ridge 61 passed the detents 37 to rotate the cylindrical member. As the first concave recess 81 and second concave recess 83 are in alignment with respect to different ends of the ridge 61 it is easy to align the respective concave recesses with the hinge pin portion of the hinge. The detents 37 provide a locating device that ensures that the ridge 61 is in the proper position to have one of the concave recesses in alignment with the hinge pin and that the ridge will remain at this alignment during use of the door prop 5.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A door prop device comprising:

a body having a triangular shape, the body having a base and angled sidewalls that extend from the base, one angled sidewall of the body being disposed so that it can engage a surface of a door and the other angled sidewall being disposed so that it can engage a door jamb, the body having a planar upper surface, the body having an end wall that extends between ends of the angled sidewalls that are spaced apart from the base, the end wall disposed for engaging a portion of a hinge;

a projection extending from the angled sidewalls in a direction away from the base, an end of the projection that is spaced apart from the base having an extension that is positioned over the hinge that can be used to secure the door to the door jamb, the projection having an upper surface that is in the same plane as the planar upper surface;

a passageway extending through the projection, the passageway being substantially cylindrical and perpendicular to the upper surface; and a member rotatably positioned in the passageway, a first portion of the member extending from the passageway, the first portion having a first and a second concave surface, the first and second concave surfaces being disposed for engaging a hinge pin on the hinge for the door, the member having a second portion that extends from the upper surface of the protection.

2. The door prop device of claim 1 wherein a flange is positioned on the member, the flange extending beyond an outer periphery of the passageway, the flange being disposed to engage the upper surface of the projection.

3. The door prop device of claim 2 wherein a ridge is positioned on the member adjacent a side of the flange that is spaced apart from the upper surface, wherein ends of the ridge extending beyond an outer periphery of the flange.

4. The door prop device of claim 3 wherein at least one detent is positioned on the upper surface adjacent the passageway, the at least one detent being disposed to engage one end of the ridge to keep the member in a desired position.

5. The door prop device of claim 4 wherein the first and second concave surfaces have a different size, the first concave surface having a radius that is larger than the radius of the second concave surface.

6. The door prop device of claim 5 wherein the first and second concave surfaces are on opposite sides of the member.

7. The door prop device of claim 6 wherein the ridge is positioned along a center line of the first and second concave surfaces wherein a position of the ridge indicates the position of the first and second concave surfaces.

8. The door prop device of claim 7 wherein a shoulder is located on the member between a first section of the member and a second section of the member.

9. The door prop device of claim 8 wherein the shoulder is in spaced apart relationship with the flange.

10. The door prop device of claim 9 wherein a resilient tab extends from the projection into the passageway, the resilient tab extending from a part of the projection that is spaced apart from the upper surface, the resilient tab being disposed to engage the shoulder on the member to retain the member in a desired position in the passageway.

* * * * *